US005289641A

United States Patent [19]

Balamuta et al.

[11] Patent Number: 5,289,641

[45] Date of Patent: Mar. 1, 1994

[54] CHEMICAL VAPOR TRAP AND VACUUM DRYING SYSTEM INCLUDING SAME

[75] Inventors: John Balamuta, Elmhurst; Richard C. Fuksa, Park Ridge, both of Ill.

[73] Assignee: Welch Vacuum Technology, Inc., Skokie, Ill.

[21] Appl. No.: 980,504

[22] Filed: Nov. 23, 1992

[51] Int. Cl.[5] ..... F26B 21/06

[52] U.S. Cl. ..... 34/75; 34/92; 34/74

[58] Field of Search ..... 34/15, 92, 28, 73, 74, 34/75; 62/261, 474, 475

[56] References Cited

U.S. PATENT DOCUMENTS

| | | | |
|---|---|---|---|
| 83,889 | 11/1868 | Taylor | 34/73 |
| 288,986 | 11/1883 | Dunlap et al. | 34/73 |
| 735,610 | 8/1903 | Stanton | 34/73 |
| 746,892 | 12/1903 | Stanton | 34/73 |
| 3,574,950 | 4/1971 | Dantoni | 34/92 |
| 3,935,646 | 2/1976 | Grandine et al. | 34/92 |
| 3,991,481 | 11/1975 | Coraor et al. | 34/28 |
| 4,020,563 | 5/1977 | Hoefer | 34/48 |
| 4,053,990 | 10/1977 | Bielinski | 34/23 |
| 4,226,669 | 10/1980 | Vilardi | 159/6 R |
| 4,347,671 | 9/1982 | Dias et al. | 34/15 |
| 4,612,710 | 9/1986 | Fernwood et al. | 34/16 |
| 4,788,778 | 12/1988 | Fernwood | 34/92 |
| 4,896,434 | 1/1990 | Fanelli | 34/1 |
| 5,025,571 | 6/1991 | Zlobinsky et al. | 34/72 |
| 5,040,312 | 8/1991 | Holzel | 34/92 |
| 5,137,604 | 8/1992 | Meeks et al. | 202/205 |

OTHER PUBLICATIONS

Tom Falzareno, Technical Description of EMPROTECH's gel dryer system, Hyde Park, Mass.
BIO-RAD's Catalog, 220-221.
SAVANT'S Catalog, New York, 1989.
FISHER's Catalog.
BIO-RAD's Gel Dryer Owners Manual.

*Primary Examiner*—Henry A. Bennet
*Attorney, Agent, or Firm*—Lockwood, Alex, FitzGibbon & Cummings

[57] ABSTRACT

A chemical vapor trap for selectively removing harmful corrosive contaminants, such as water and acetic acid vapors, from an evacuating vapor phase in a vacuum drying system is provided. The chemical vapor trap includes a condenser section effective to convert a high temperature incoming heated sample liquids and heated vapor phase into a liquid phase condensate and a relatively lower room temperature stripped vapor phase. Liquid condensate including water and acetic acid are trapped below a chemical blanket or sealing layer which prevents re-vaporization or boiling of removed corrosive volatile contaminants from the vapor phase entering the vacuum pumps, promoting improved pump performance and extend pump service life.

18 Claims, 6 Drawing Sheets

CHEMICAL VAPOR TRAP AND VACUUM DRYING SYSTEM INCLUDING SAME

BACKGROUND OF THE INVENTION

The present invention generally relates to apparatus and methods for drying samples under conditions of elevated temperature and reduced pressure. More particularly, it relates to a new and improved chemical vapor trap for use in a vacuum drying system which is effective to selectively remove water, acetic acid and other materials known to be harmful to vacuum pump operation and service life by isolating these materials from the drying vapor phase and blanketing them under a chemical blanket to prevent their undesired revaporization during the remainder of the sample drying operation.

Vacuum drying instruments are presently known and used for various scientific purposes. Illustrative examples include gel dryers, specimen dryers, rotary evaporators, vacuum centrifuges and filtration manifolds. The sample may be a biological specimen or fluid or it may be a treated substrate material to be used in subsequent analytical determinations. The samples generally contain a solvent portion or fraction to be removed which typically includes water, acids, organic liquids and other solvents. The solvents are removed in these devices by applying heat and vacuum to a drying chamber containing the samples. The liquid and vapor forms of most of these solvents are known to be deleterious to the vacuum pumps used for creating a partial vacuum in the drying chambers.

More particularly, oil sealed rotary vane vacuum pumps are used to create a vacuum in a sample chamber. Oil sealed rotary vane vacuum pumps are preferred because of the good pumping speeds and rapid and efficient ability to dry a sample. A major drawback previously associated with rotary vane pumps is that heated water vapor and acetic acid condense in the pump in the oil case resulting in an acetic acid, water and oil emulsion. In rotary pumps wherein the lubricating oil is fed from the oil case, the water settles at the bottom of the pump case. At start up, instead of receiving oil lubricant, the pump sees acidified water which is non-lubricating when the condensed solution reaches the oil feed hole. Often what happens is that after start up, the pumps actually freeze up from lack of lubricant. Efforts to prevent entry of heated liquids into the pump or condensation of heated acidified water in the pump have included placing a liquid trap in line before the vacuum pump to trap and remove liquid phase materials evolving from the heated sample. The liquid traps are generally effective to prevent large amounts of liquids from traveling directly from the sample to the pump, however, a liquid trap cannot prevent vapor phase contaminants such as acetic acid and water vapor from entering the pump. Moreover, at lower pressures the trapped liquids may volatilize and add to the corrosive vapor load feeding to the pump which is undesirable.

Prior attempts to reduce or eliminate vapor phase corrosive contaminants have included placing a cold trap between the liquid trap and the vacuum pump to cause water and acetic acid to condense out of the vapor phase feed to the vacuum pump. The vapor phase load at the beginning of a drying cycle is often too large for the condenser capacity so that contaminated vapors still reach the pump in an undesirably high concentration. Moreover, solvent flashing and fly-by can occur in the cold trap permitting hot corrosive vapors also to exit the cold trap in a high concentration. Furthermore, cold traps are maintenance intensive requiring setup for each drying session and the cost of refrigerants is an undesirable extra expense.

In view of the problems associated with premature failures and problematic maintenance of oil sealed rotary vane pumps, a compromise has been made by employing lower speed, less efficient diaphragm vacuum pumps, because they are generally more resistant to vapor phase composition. Liquid phase contaminants carried over into a diaphragm vacuum pump or condensed from vapor phase materials in the pump itself cause damage to the diaphragms and premature failure of the pumps. In the past, diaphragm pumps were believed to provide an agreeable alternative to rotary vane vacuum pumps because the need for a cold trap could be dispensed with. A liquid trap is generally used to collect liquid phase contaminants. At lower system pressures achieved by vacuum pump evacuation, the liquid in the trap revaporizes into the vapor phase which may condense in the pump and cause premature diaphragm failure. Often people have suggested the use of a cold trap in a diaphragm pump system which represents an unacceptable compromise because the maintenance issues concerning the cold trap are not avoided and the pump has a slower pumping rate leading to slow, i.e. unacceptably long, drying times.

Other efforts to alleviate or avoid solvent contamination of the vacuum pumping devices in drying systems, have included the suggestions made in U.S. Pat. No. 5,137,604 and U.S. Pat. No. 5,025,571. In the first of these patents, a cold trap is employed in connection with an elaborate switching device for opening the cold trap and sample chamber to vacuum in discrete episodes. This proposed improvement incrementally passes evolving vapor phase materials through the cold trap to increase the residence time of the vapor phase in the condenser to more effectively remove the corrosive contaminants from the vapor phase prior to entry into the pump. The vapor phase and liquid phase spill over from most samples is so high at the beginning stages of the drying cycle that incomplete condensation is the norm, so that contaminants still reach the pump and can condense therein and cause damage. More importantly, the drying times of the samples are undesirably long and cold trap maintenance is not avoided.

In U.S. Pat. No. 5,025,571, another method of preventing liquid egress comprises collecting liquids and condensed vapors in a heated liquid trap which effectively revaporizes all evolving solvent to heated vapor phase form before entering the diaphragm pump. Preheating still does not and cannot prevent the undesirable condensation of harmful corrosive liquids within the pump itself which is a disadvantage, particularly in view of the compromise already made in terms of pumping speed and drying times for these diaphragm pump systems.

Accordingly, to overcome the disadvantages of prior art vacuum drying systems, it is an object of the present invention to provide a new and improved chemical vapor trap which is generally effective to selectively substantially remove water and/or acetic acid contaminants from a vapor phase in a vacuum drying system, regardless of vacuum source, to prevent these corrosive materials from entering the vacuum pump.

It is another object of the present invention to provide a new and improved chemical vapor trap which is effective to selectively remove water and acetic acid from an evolving vapor phase in a vacuum drying system by condensing these materials into a liquid phase condensate and isolating the condensate from the vacuum system in a manner which prevents re-vaporization and reintroduction of the corrosive acid and water materials into the vapor phase being fed to the vacuum pump.

It is another object of the present invention to provide a new and improved vacuum drying system for drying samples which is faster, and more efficient, at drying sample materials in a relatively maintenance-free manner as compared to prior art vacuum drying systems.

SUMMARY OF THE INVENTION

In accordance with these and other objects, the present invention provides a new and improved apparatus for selectively removing undesired components from a heated vapor phase evolving from a sample in a heated sample drying chamber and passing into a vacuum source for inducing a vacuum in the sample drying chamber. More particularly, the present invention provides a new and improved chemical vapor trap apparatus comprising housing means. A condenser means is provided in said housing for cooling the heated vapor phase to cause the undesired components, usually acetic acid and water vapor, to condense out of the heated vapor phase. The condenser causes formation of a separated liquid condensate phase and a remaining stripped vapor phase. The stripped vapor phase preferably does not contain vapors harmful to the vacuum source.

The chemical vapor trap apparatus also comprises collector means in said housing positioned to receive and collect the separated liquid condensate phase from the condenser. In accordance with this invention, the collector includes a sealing layer of a liquid sealing material. The liquid sealing material is a liquid having a specific gravity which is less than the specific gravity of the liquid condensate. The liquid sealing material also has a vapor pressure at ambient collector temperatures less than the vapor pressure of the liquid phase condensate at the same temperatures. In accordance with the invention, the sealing layer therefore floats on top of the collected liquid condensate. Moreover, condensing liquid condensate formed in the condenser falls through the sealing layer and is trapped under the liquid sealing layer effectively isolated and removed from the vapor phase feeding to the vacuum source.

The new and improved chemical vapor trap apparatus additionally includes means for connecting the condenser to the sample drying chamber and means for connecting the collector and condenser to the vacuum source. Furthermore, the chemical vapor trap apparatus of this invention includes means for maintaining the pressure within the collector above a predetermined minimum pressure so that the liquid cooling layer is effective to prevent re-vaporization and/or boiling of the condensed liquid condensate into the stripped vapor phase exiting the condenser and collector and traveling to the vacuum source.

In accordance with a preferred embodiment, the chemical vapor trap apparatus is provided in a single automatic self-contained unit adapted for connection in-line between the vacuum pump source of vacuum and a liquid trap which is in turn connected to the drying chamber of the sample dryer device.

In accordance with the invention, the liquid phase materials released from the sample at the early stages of a drying cycle are collected in the chemical vapor trap. The evolving or evaporating vapor phase exiting the drying chamber is generally heated to elevated temperatures above room temperature and typically the heated vapor phase entering the chemical vapor trap is between about 50° C. to about 100° C. and preferably is between about 60° C. to about 90° C. The condenser means should provide a cooling temperature differential sufficient to cause rapid condensation to undesired corrosive volatile contaminants from the vapor phase before it exits the condenser portion and enters the collector portion as a stripped vapor phase and a condensed separated liquid phase condensate. Preferably the condenser is effective to drop the temperature of the heated vapor phase by at least about 30° C., preferably at least about 40° C., and especially preferably the condenser is effective to drop the temperature of the heated vapor phase to an exiting room temperature stripped vapor phase. By room temperatures is meant temperatures of between about 15° C. to about 32° C. or between about 60° F. to about 90° F. In a preferred embodiment the condenser portion comprises a heat exchanger coil for conveying heated vapor phase materials extending through a cooling air stream at room temperatures provided by a circulatory fan provided in the housing.

In the preferred embodiment, the collector is positioned in the housing generally under the exit of condenser portion to receive and collect separated liquid phase condensate by gravity. As has been mentioned above, the most harmful vapor phase materials responsible for vacuum pump damage and failure generally include high temperature water, and acetic acid, and possibly other mineral acids. The vapor phase may also include alcohols such as methanol and glycols which are not as detrimental to the vacuum pumps and generally pass through the vacuum pump in the form of gases in the stripped vapor phase.

In accordance with the preferred embodiment, the liquid chemical sealing layer comprises an organic liquid and liquid hydrocarbons are preferred. Especially preferred for use herein as the liquid sealing layer is a light liquid petrolatum or mineral oil having a specific gravity at 20° C. of between about 0.800 to about 0.900. The quantity of liquid sealing material should be sufficient together with the pressure of the collector head space to overcome the vapor pressure of the collected and trapped liquid condensate to prevent re-vaporization. In a collector vessel having dimension of about 7"×6"×5", a liquid sealing layer of one inch is more than sufficient to trap liquid condensate and effectively remove it from the vapor phase.

In accordance with this invention, the new and improved chemical vapor trap includes an orifice means in the collector to maintain the pressure in said collector above a minimum pressure, such as 30 Torr, which is about the vapor pressure of water at about 30° C. The orifice may be of a fixed or variable diameter type but for a given speed vacuum pump is generally selected to prevent the pressure from falling too low in the collector which would permit undesirable re-vaporization of condensate.

In accordance with the present invention, the new and improved chemical vapor trap may be used with a variety of vacuum pump vacuum sources. In accordance with the preferred embodiment, use of the chemical vapor trap of this invention once again permits the use of faster, more efficient oil sealed rotary vane and gerotor or geared vacuum pumps in vacuum drying systems, without the maintenance problems associated with prior art labor intensive cold traps and without the same pump oil contamination problems previously encountered. The use of the chemical vapor trap of this invention with diaphragm vacuum pumps permits the diaphragm pumps to be operated at higher pump speeds thereby improving sample drying times.

Other objects and advantages of the present invention will become apparent from the following Detailed Description of the Invention taken in conjunction with the Drawings, in which:

DETAILED DESCRIPTION OF THE PREFERRED EMBODIMENTS

Figure 1:
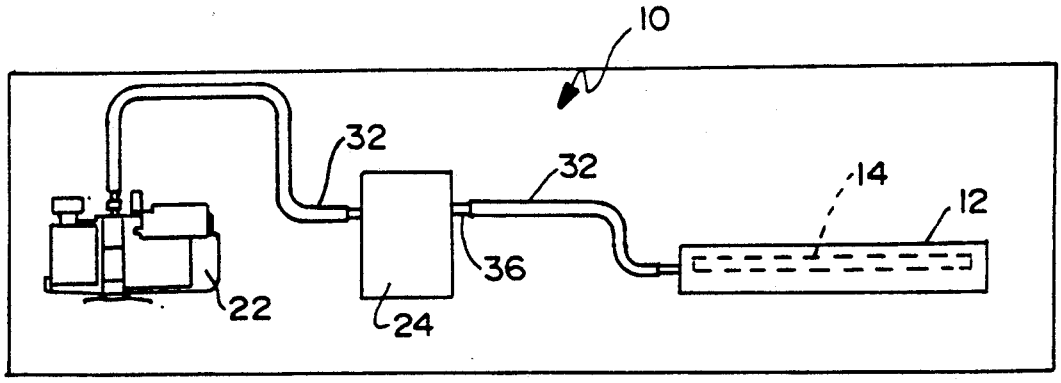
FIG. 1 is a schematic diagram illustrating the components of a preferred vacuum drying system for drying a sample material under conditions of elevated temperature and reduced pressure.
Figure 2:
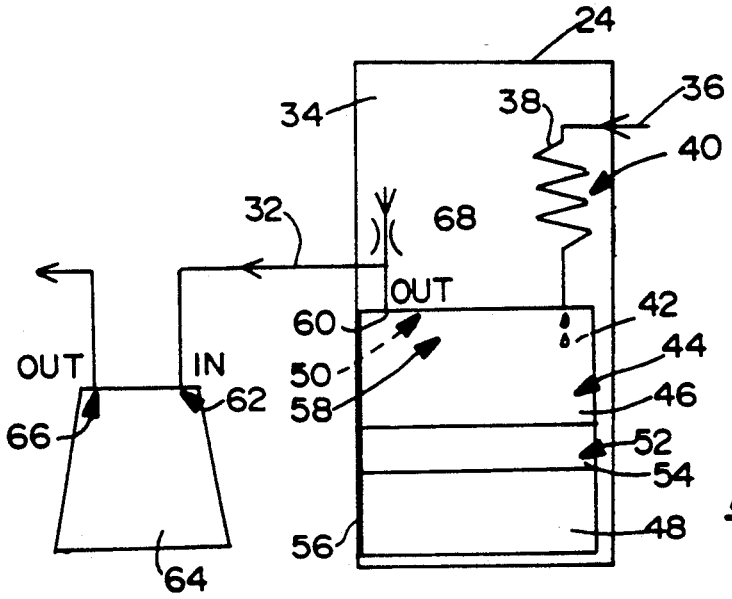
FIG. 2 is a schematic view of the new and improved chemical vapor trap of the present invention.

Referring now to FIG. 1, a schematic view of a new and improved sample vacuum drying system 10 in accordance with this invention is shown. Vacuum drying system 10 comprises a number of pneumatically connected components including: a sample drying chamber 12 wherein a sample 14 is subjected to conditions of elevated temperature and reduced pressure. A source of vacuum 22 is provided, preferably an oil sealed gerotor, geared, rotary vane pump or a diaphragm vacuum pump to create a vacuum in the system 10 at start up. In accordance with the present invention a new and improved chemical vapor trap 24 is provided in-line between vacuum pump 22 and the heated sample drying chamber 12 to selectively remove undesirable liquid phase and gaseous components from the evacuating vapor phase 20 passing through the system 10 from the sample drying chamber 12 to the exhaust of vacuum pump 22 whereupon it is released into the ambient atmosphere outside or external to system 10. In accordance with the present invention beneficial advantages are provided in a variety of vacuum drying systems, such as system 10, by incorporating therein the new and improved chemical vapor trap 24. Accordingly, in vacuum drying system 10, the sample drying chamber and device 12 may be an electrophoresis gel dryer, a vacuum oven or a rotary evaporator, to name a few. In the preferred embodiment, the sample vacuum dryer 12 comprises a gel dryer adapted to heat an agarose or acrylamide gel sample to temperatures of between about 60° C. to about 90° C. preferably above 75° C. and to operate at an ultimate vacuum of greater than 30 Torr, preferably between about 40 Torr to about 100 Torr. Under these conditions, a thin gel having a thickness up to about 0.5 cm may be dried in a period of less than 6.0 hours, and preferably within between about 20 minutes to about 4.0 hours.

The vacuum pump sources 22 for creating a vacuum in system 10 may include diaphragm pumps or oil sealed gerotor or rotary vane pumps. The vacuum pump selected should have a free air displacement of between about 20 liters per minute to about 100 liters per minute and should develop an ultimate vacuum of between about less than 10 micron and up to about 29.5 inches of mercury (between about 1 Torr up to about 74 Torr). An especially preferred vacuum pump is the GEM TM Vacuum Pump available from Welch Vacuum Technology, Inc., Skokie, Illinois. The GEM TM Vacuum Pump is an oil sealed gerotor pump rated at about 30 liters per minute and operating at a steady nonfluctuating vacuum at 0.1 mm of mercury up to 760 mm. Although rotary vane pumps are preferred because they dry gels faster, other diaphragm type vacuum pumps may also be used, although the diaphragm types may take twice as long to dry the gels.

In accordance with the preferred embodiment, all connections between individual components 12, 16, 24 and 22 making up the dryer system 10 are made by large bore diameter heavy gauge vacuum tubing 32.

Referring now to the schematic view of the new and improved chemical vapor trap 24 of this invention, chemical vapor trap 24 includes a housing 34 having an inlet 36 for receiving a heated vapor phase material 20 at about 90° C. Inlet 36 communicates with the interior of a heat exchanger coil 38 of a condenser section 40. Condensed water vapor and acetic acid in the form of a liquid phase condensate 48 is formed in condenser section 40. The remaining stripped vapor phase 50 and liquid condensate 48 exit from coil 38 at coil exit 42 at a cooled temperature of about 30° C. and enter the collector section 44. Collector section 44 includes a collector vessel 46 having a liquid sealing layer 52 of a liquid sealing material 54. Liquid sealing material 54 has a density lower than that of the liquid condensate 48 and a vapor pressure at room temperatures about 25 to 30° C. which is lower than that of the liquid condensate 48 (about 30 Torr). Accordingly, liquid sealing layer 52 floats on top of liquid condensate 48 and effectively seals off any collected liquid condensate 48 falling from coil exit 42, through sealing layer 52 into the lower portion 56 of collector vessel 46 from the evacuating vapor phase 50.

Stripped vapor phase 50 flows from the coil exit 42 along the upper head space 58 of collector vessel 46 through a vapor phase collector exit 60, into the inlet port 62 of the vacuum pump 64 and exits as exhaust from pump exhaust exit port 66.

In accordance with the invention, a pressure regulating orifice 68 is provided in said collector upper head space 58 to maintain minimum pressure within collector section 44 and elsewhere throughout the system to prevent the combined pressure of the stripped vapor phase 50 in head space 58 and the weight or pressure exerted by the liquid sealing layer 52 from falling below the vapor pressure of trapped liquid condensate 48. As a result, the trapped condensate 48 is prevented from re-vaporizing into the stripped vapor stream 50 and does not enter and contaminate the vacuum pump 64. The pressure regulating orifice 68 has either a fixed or variable diameter, selected to work with the chosen vacuum pump 64 to provide a minimum internal pressure in collector overhead space of about 30 Torr. Pump damaging .vapors are effectively removed from the vapor phase 50 before it enters the vacuum pump 64 so that the use of the new and improved chemical vapor trap 24 provides improved pump performance and prolonged pump service life.

Figure 3:
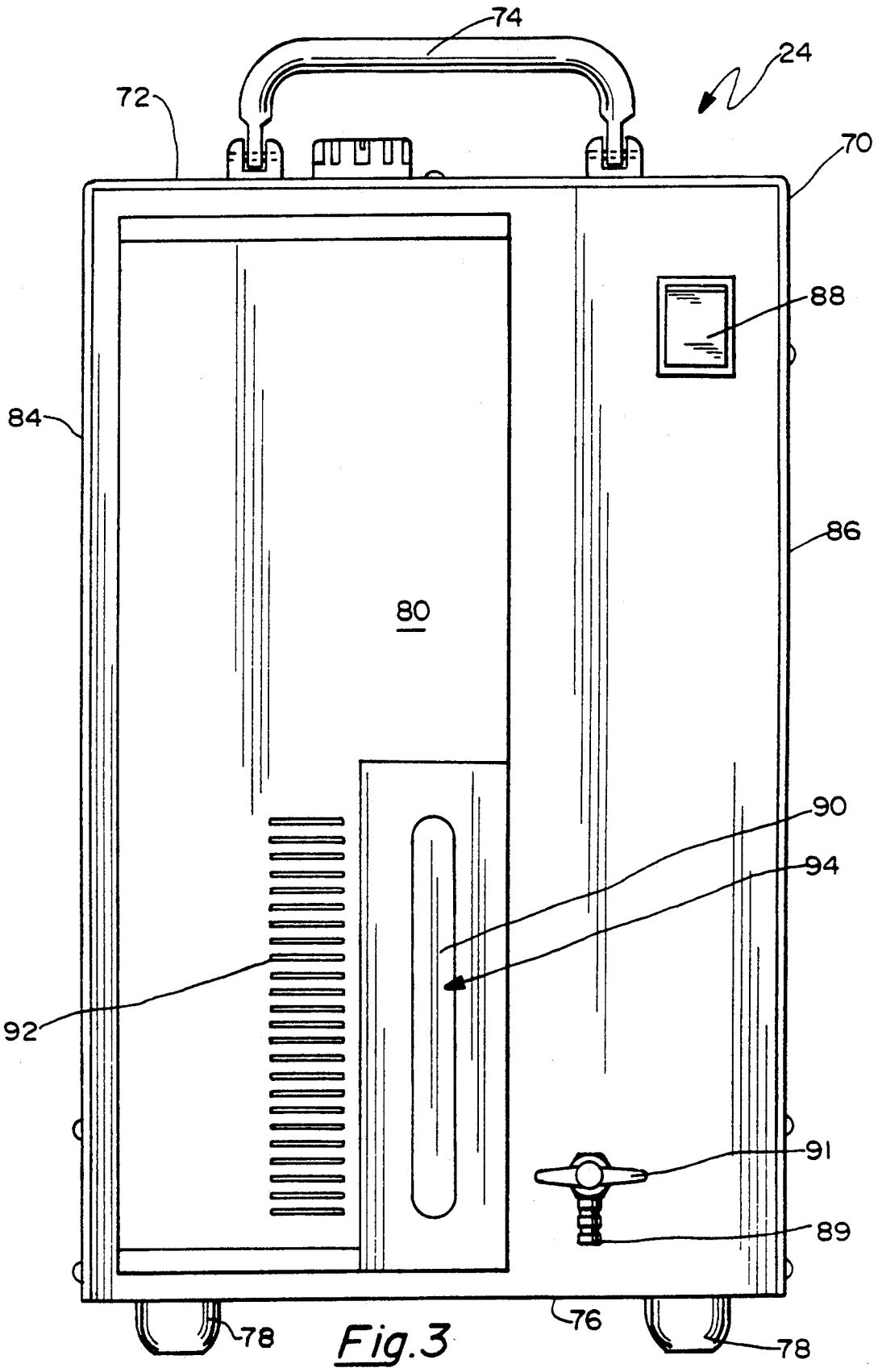
FIG. 3 is a front elevation view of the new and improved chemical vapor trap apparatus in accordance with the present invention.

Referring now to FIGS. 3–7, a preferred embodiment of new and improved chemical vapor trap 24 is shown. Chemical vapor trap 24 includes an upstanding generally rectangular housing 70 including a top wall 72 equipped with a carrying handle 74, an opposed bottom wall 76 with anti-skid feet 78 depending therefrom. Housing 70 includes an upstanding front wall 80 and opposed rear wall 82 and a pair of upstanding side walls, 84 and 86, respectively. As shown in FIG. 3, front wall 80 includes an on/off power switch 88, a see-through window 90 and indicia 92 providing a liquid level gauge 94 for observing the relative fullness of collector vessel 46 disposed inside housing 70. In accordance with the preferred embodiment shown in FIG. 3, a drainage spigot 89 with rotatable on/off valve 91 projects forwardly from the lower end of front wall 80 for emptying collected liquid phase condensate 48 as necessary between sample drying runs. In accordance with an especially preferred embodiment, the sealing layer 52 includes a liquid sealing material 54 having a coloring agent dispersed therein to improve visibility of the liquid level on gauge 94.

Figure 4:
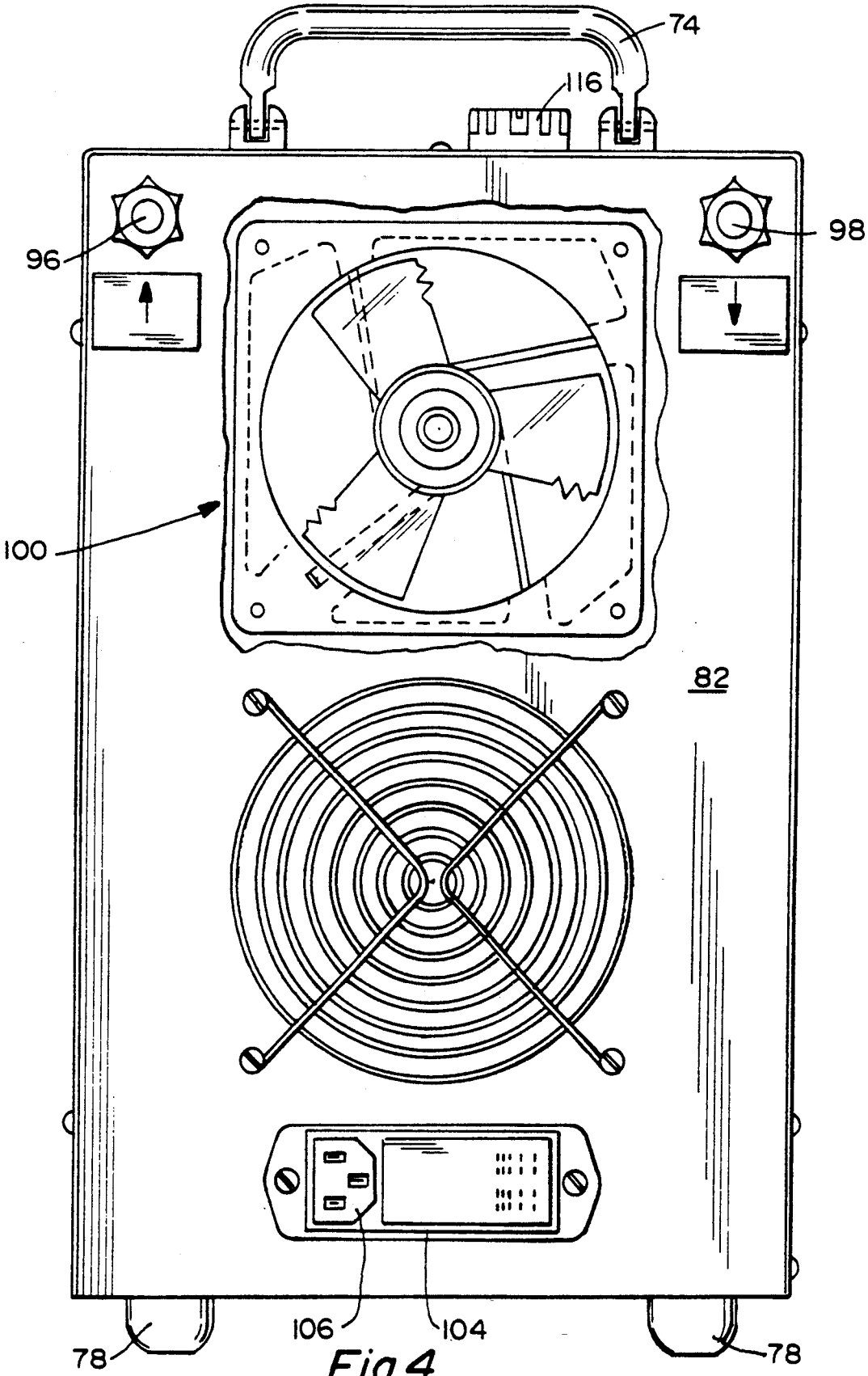
FIG. 4 is a rear elevation view of the new and improved chemical vapor trap apparatus of the present invention.

Referring now to FIG. 4, rear wall 82 includes a pair of hose connection ports 96 and 98 projecting therefrom. Port 96 is provided for connecting the liquid trap 16 and sample drying chamber 12 to the condenser inlet 36 of chemical vapor trap 24. Port 98 is provided for connecting the collector exit 60 to the inlet 62 on a vacuum pump such as pump 64. Upper and lower electrical cooling fan assemblies 100 and 102 are provided to maintain a constant flow of room temperature air throughout the condenser section 40 and collector section 44 within housing 70 to maintain a temperature differential between the entering vapor phase 20 and the coil exiting stripped vapor phase 50 of at least about 40° C. Rear wall 82 also includes an electric power distribution panel 104 with an electric cord and plug receiving connector 106 for providing operating current to the chemical vapor trap unit 24. A protective screen or grill work 108 may be provided to protect against accidental contact with fan blade assemblies 100 and 102. Fan assemblies 100 and 102 are generally effective to provide a flow of room temperature air through the device at a rate of about 8 liters per minute. Exit air vents, not shown, may be provided in top and bottom walls 72 and 76 and side walls 84 and 86.

Figure 5:
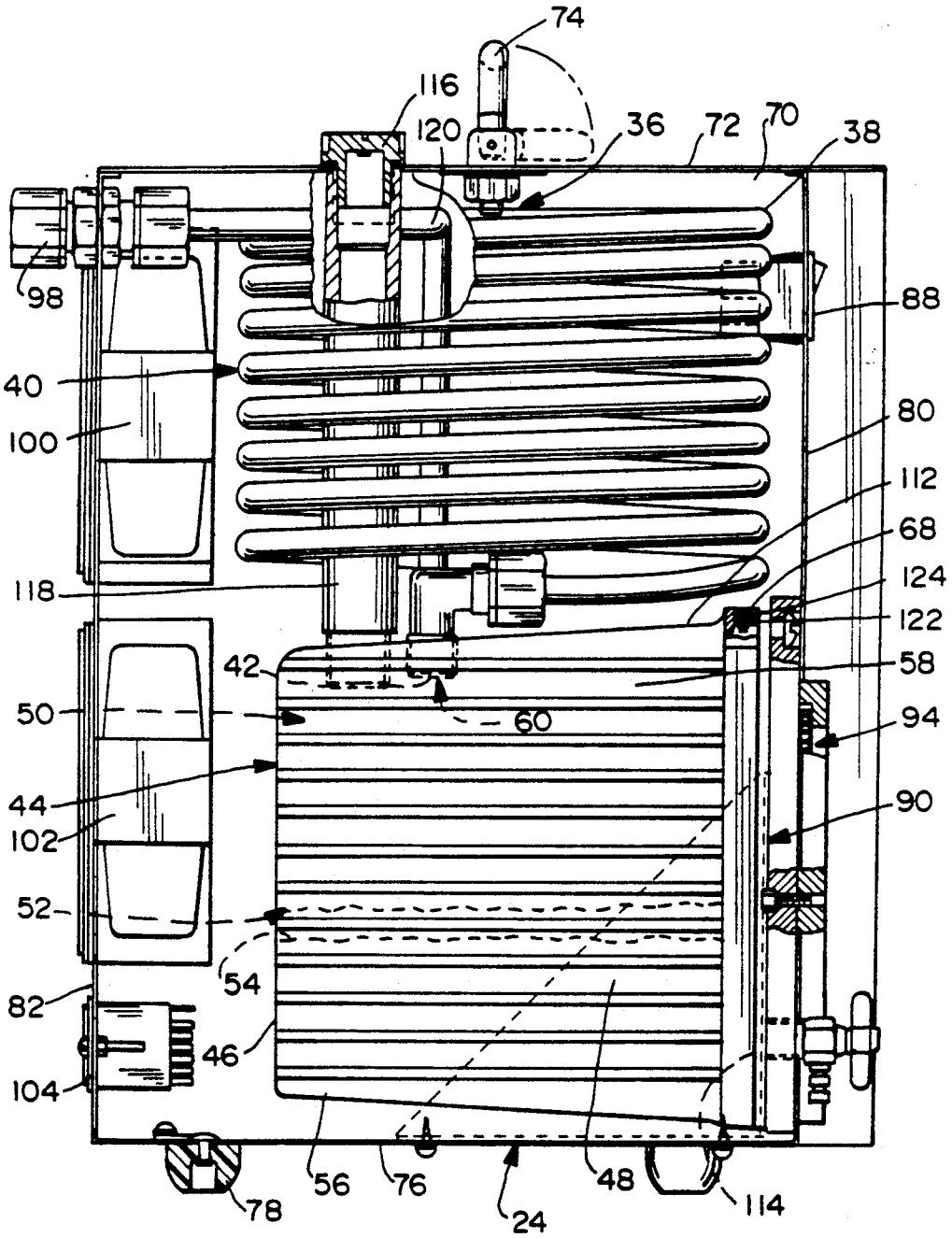
FIG. 5 is an elevated cross-sectional view of the new and improved chemical vapor trap apparatus of the present invention taken along view lines 5—5 in FIG. 4.
Figure 6:
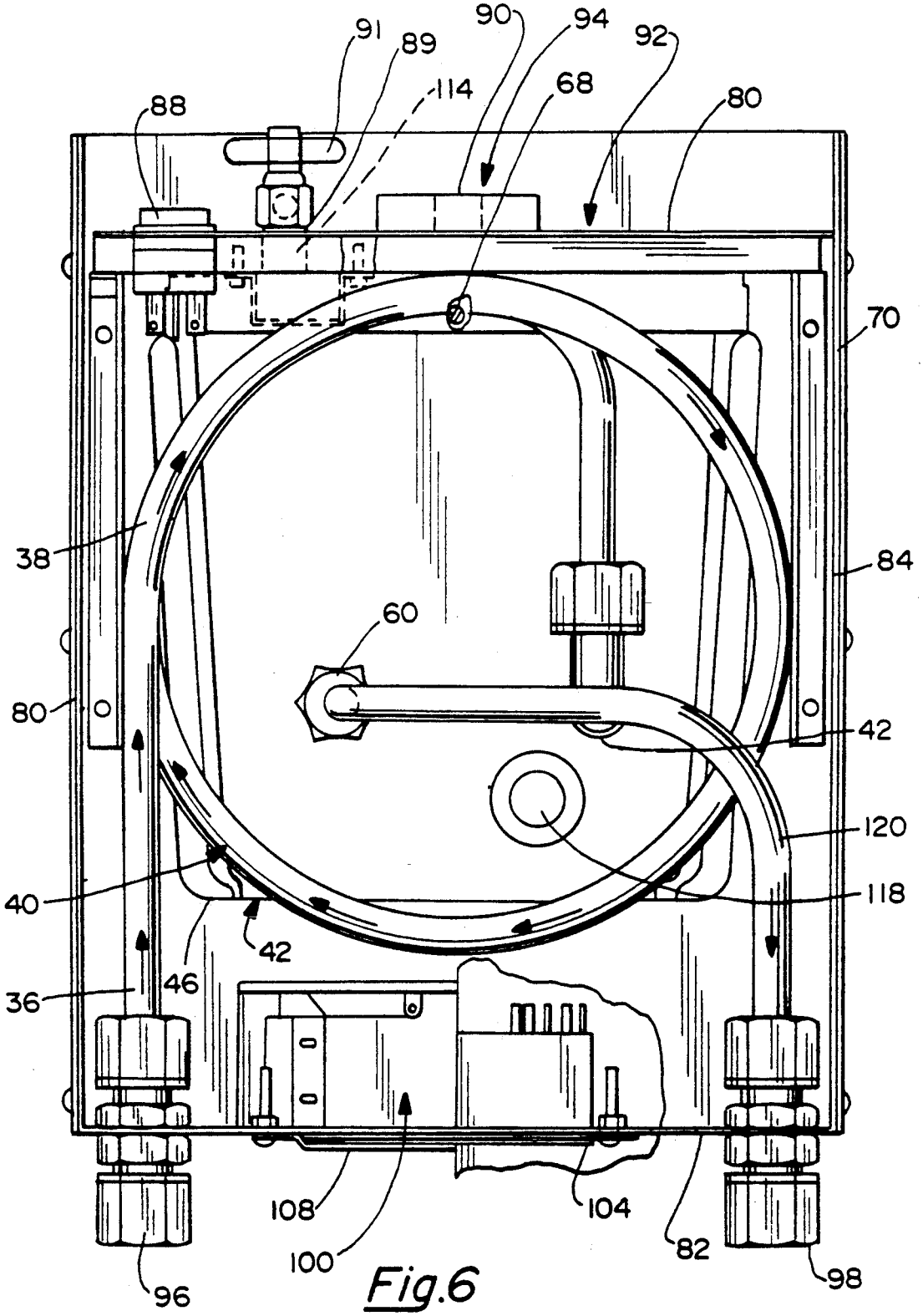
FIG. 6 is a cross-sectional view from the top of the new and improved chemical vapor trap apparatus of the present invention taken along view lines 6—6 in FIG. 3.

Referring now to FIGS. 5 and 6, within housing 70, the condenser section 40 is provided above the lower collector section 44. Condenser section 40 includes a heat exchanger or condenser coil 38 having an inlet end 36 communicating with port 96 and a lower coil exit end 42 disposed in sealed relation within a top wall 112 of a large capacity, e.g. 4.0 to 6.0 liter , collector vessel 46 preferably made from a pressure resistant metallic material, and aluminum is especially preferred.

Figure 8:
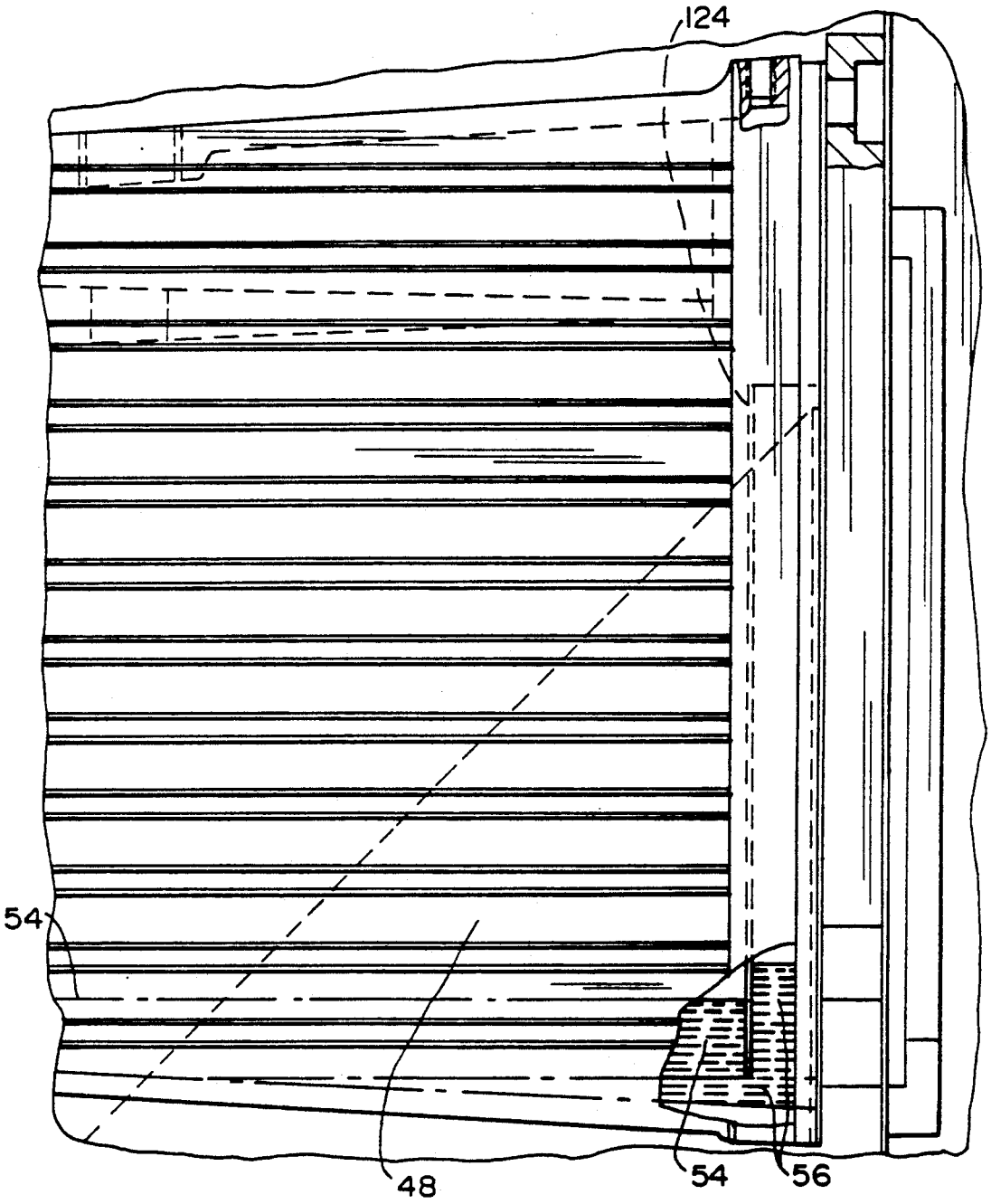
FIG. 8 is an elevated cross-sectional view of the new and improved chemical vapor trap in accordance with the preferred embodiment, similar to FIG. 5, including a drain baffle to prevent unintentational draining of the liquid sealing layer.

Collector vessel 46 includes a lower front drainage port 114 communicating with drainage spigot 89 and valve 91. In accordance with the preferred embodiment best shown in FIGS. 6 and 8, a drain baffle 124 is provided to ensure that collected condensate drains out of drainage port 114 first, without draining out the liquid sealing material 54. A fixed diameter pressure regulating orifice 68 is shown in the upper front portion of vessel 46, as shown in FIG. 4, which is effective to maintain the pressure in vessel 46 above a predetermined minimum amount. Liquid sealing layer 52 is disposed in the lower portion of vessel 46 and is introduced therein through stoppered filler port 116 provided in top wall 72 and along filler tube 118 which is sealably received through top wall 112 into the upper space of collector vessel 46. As shown in FIGS. 4 and 5, collector exit 60 includes an exit tube 120 which communicates with rear port 98 connected to vacuum pump 64 inlet 62.

Figure 7:
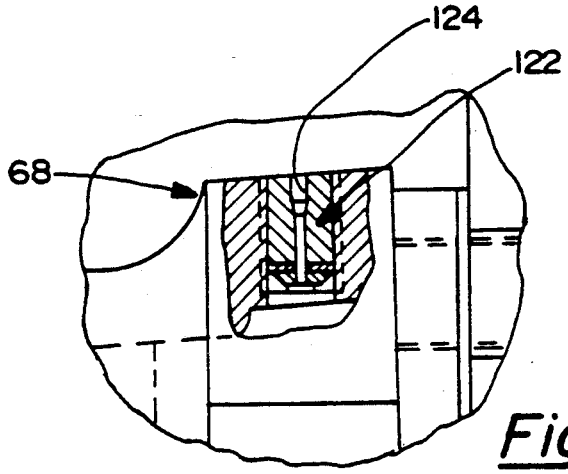
FIG. 7 is an enlarged cross-sectional elevation view of the controlled leak orifice in accordance with a preferred embodiment for maintaining the pressure within the chemical vapor trap of the present invention above a predetermined minimum pressure.

Referring now to FIG. 7, the pressure regulating orifice 68 is provided in a threaded and sealed orifice insert member 122 having a controlled diameter opening 124 for fixed venting the collector vessel in a controlled regulating manner. Although a fixed orifice 68 is shown, an adjustable bleeder valve may be used to maintain the internal pressure in collector vessel 46.

Unexpectedly, it has now been observed that the new and improved chemical vapor trap 24 is generally effective to remove substantially all pump damaging amounts acetic acid and water vapor from the vapor phase 20. More particularly, it has been observed that during the early stages in the vacuum drying cycle, after liquid phase materials have been effectively separated in a chemical vapor trap 24, very saturated vapor phase materials are evolved like a fog of droplets and gases. Rapid condensation of the saturated water vapor has been observed to cause co-condensation and removal of substantially all harmful levels of acetic acid contaminants. When experiments were conducted, adding increasing amounts of acetic acid into a fabricated vapor phase which was pulled through the chemical vapor trap 24, substantially all of the acetic acid was removed and trapped under the chemical oil blanket or sealing layer 52 with little or no noticeable acetic acid fumes being discharged out of the pump exhaust port 66.

Although the present invention has been described with reference to certain preferred embodiments, modifications may be made therein by those skilled in this art. For example, instead of a low density mineral oil being used as the chemical sealing layer, another organic liquid may be used provided it has a specific gravity and vapor pressure less than that of the liquid phase condensate. Instead of using an oil sealed rotary vane vacuum pump, a diaphragm pump may be substituted. Instead of using a flow of room temperature air for cooling the heated vapor phase in the condenser section, another cooling heat exchange medium may also be employed. All such obvious modifications may be made herein by those skilled in this art without departing from the scope and spirit of the present invention as defined by the appended claims.

What is claimed is:

1. An apparatus for selectively removing undesired components from a heated vapor phase and hot liquid phase evolving from a sample in a heated drying chamber and passing into a vacuum source for inducing a vacuum in said sample drying chamber, said apparatus comprising:

a housing;

a condenser in said housing for cooling said heated vapor phase to cause said undesired components to condense out of said heated vapor phase to form a separated liquid condensate phase and a remaining stripped vapor phase;

a collector in said housing positioned to receive and collect sample liquids and said separated liquid condensate phase from the condenser, said collector including a sealing layer of a liquid sealing material, said liquid sealing material having a specific gravity less than that of said liquid condensate and having a vapor pressure at ambient collector temperatures of less than that of said sample liquid and said liquid condensate so that the sealing layer floats on top of collected sample liquid and said liquid condensate and sample liquid and condensing liquid condensate formed in the condenser falls through the sealing layer and is trapped thereunder;

means for connecting the condenser to said sample drying chamber;

means for connecting the condenser and collector to said vacuum source; and means for maintaining the pressure within said collector above a predetermined minimum pressure so that said liquid sealing layer is effective to prevent re-vaporization of said collected sample liquid and said liquid condensate into said stripped vapor phase exiting the collector and travelling to said vacuum source.

2. An apparatus as defined in claim 1, wherein said condenser is disposed in said housing above said collector so that condensing liquid condensate falls by gravity into said collector.

3. An apparatus as defined in claim 1, wherein said condenser comprises a heat exchanger coil and a surrounding cooling medium.

4. An apparatus as defined in claim 1, wherein said condenser is effective to condense and separate as liquid condensate, undesired components of said heated vapor phase, said undesired components being selected from the group comprising water, alcohols, acetic acid, mineral acids and mixtures of any of the foregoing.

5. An apparatus as defined in claim 4, wherein said undesired components are acetic acid and water.

6. An apparatus as defined in claim 4, wherein said liquid sealing material comprises an organic liquid.

7. An apparatus as defined in claim 6, wherein said organic liquid comprises a liquid hydrocarbon.

8. An apparatus as defined in claim 7, wherein said liquid hydrocarbon comprises mineral oil.

9. An apparatus as defined in claim 1, wherein said means for maintaining the pressure in the collector above a minimum pressure comprises an orifice communicating with the ambient environment.

10. An apparatus as defined in claim 9, wherein said orifice is a fixed orifice.

11. An apparatus as defined in claim 9, wherein said orifice is a variable orifice.

12. An apparatus as defined in claim 3, wherein said cooling medium is an ambient temperature air stream moved past said coil by a fan.

13. An apparatus as defined in claim 3 wherein said cooling medium comprises a cooling chemical bath.

14. An apparatus as defined in claim 13, wherein said cooling chemical bath comprises a dry ice/isopropanol slurry.

15. An apparatus as defined in claim 1, wherein each said means for connecting includes vacuum tubing.

16. An apparatus as defined in claim 3, wherein said cooling medium is provided by a mechanically refrigerated cooling system.

17. An apparatus for drying a solvent-containing sample, said apparatus comprising:

a ample drying chamber for receiving a sample to be dried in an air-tight, sealed manner, said drying chamber including means for heating a sample contained therein to elevated temperatures above room temperature;

a vacuum pump;

conduit connecting said vacuum pump with said drying chamber; and a chemical vapor trap disposed in said conduit intermediate said sample drying chamber and said vacuum pump, said chemical vapor trap being effective to selectively remove undesired components including substantially all sample liquids and water and acetic acid vapor from a heated vapor phase and hot liquid phase evolving from the sample in said heated drying chamber before a remaining stripped vapor phase is passed along said conduit into said a vacuum pump, said chemical vapor trap including: a housing; a condenser in said housing for cooling said heated vapor phase to cause said undesired components to condense out of said heated vapor phase to form a separated liquid condensate phase and a remaining stripped vapor phase; a collector in said housing positioned to receive and collect sample liquids and said separated liquid condensate phase from the condenser, said collector including a sealing layer of a liquid sealing material, said liquid sealing material having a specific gravity less than that of said liquid condensate and having a vapor pressure at ambient collector temperatures of less than that of said sample liquid and said liquid condensate so that the sealing layer floats on top of collected sample liquid and said liquid condensate and sample liquid and condensing liquid condensate formed in the condenser falls through the sealing layer and is trapped thereunder; and means for maintaining the pressure within said collector above a predetermined minimum pressure, so that said liquid sealing layer is effective to prevent re-vaporization of said collected sample liquid and said liquid condensate into said stripped vapor phase exiting the collector and travelling to said vacuum pump.

18. An apparatus as defined in claim 17, wherein said sample drying chamber comprises a gel drying chamber for drying electrophoresis gels.

* * * * *